US006331752B1

(12) United States Patent
Tojyou et al.

(10) Patent No.: US 6,331,752 B1
(45) **Date of Patent: *Dec. 18, 2001**

(54) COLOR CATHODE RAY TUBE HAVING A LOW DYNAMIC FOCUS VOLTAGE

(75) Inventors: Tutomu Tojyou, Chousei-gun; Shoji Shirai; Shinichi Kato, both of Mobara, all of (JP)

(73) Assignee: Hitachi, Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/433,726

(22) Filed: Nov. 4, 1999

Related U.S. Application Data

(63) Continuation of application No. 09/012,450, filed on Jan. 23, 1998, now Pat. No. 6,025,674, which is a continuation of application No. 08/808,037, filed on Mar. 4, 1997, now Pat. No. 5,739,631, which is a continuation of application No. 08/504,139, filed on Jul. 19, 1995, now Pat. No. 5,608,284.

(30) Foreign Application Priority Data

Jul. 19, 1994 (JP) ..... 6-167120

(51) Int. Cl.[7] ..... H01J 29/46; H01J 29/50; H01J 29/56; H01J 29/58

(52) U.S. Cl. ..... 313/441; 313/414; 313/412; 315/15; 315/382

(58) Field of Search ..... 313/412, 413, 313/414, 449, 441; 315/15, 14, 382

(56) References Cited

U.S. PATENT DOCUMENTS 4,032,133 6/1977 Steffens et al. .

(List continued on next page.)

FOREIGN PATENT DOCUMENTS 0 284 990 A2 10/1988 (EP) .

(List continued on next page.)

OTHER PUBLICATIONS

"Enhanced Elliptical Aperture Lens Gun for Color Picture Tubes", S. Shirai, et al, 2320 Proceedings of the SAID, vol. 31/3, 1990, pp. 185–191.

*Primary Examiner*—Nimeshkumar D. Patel
*Assistant Examiner*—Mack Haynes
(74) *Attorney, Agent, or Firm*—Antonelli, Terry, Stout & Kraus, LLP

(57) ABSTRACT

A color cathode ray tube having an electron gun including a beam forming region for generating a plurality of electron beams from cathodes and directing the plurality of electron beams toward a phosphor screen along initial paths in a horizontal plane, and a main lens for focusing the plurality of electron beams on the phosphor screen. The main lens including a final lens configured so that the plurality of electron beams are focused in both horizontal direction and a vertical direction with outer electron beams among the plurality of electron beams being deflected toward a trajectory of a center electron beam among the plurality of electron beams, and a lens strength thereof being weakened with an increase in an amount of deflection of the plurality of electron beams. The color cathode ray tube further includes at least one correction lens for curvature of an image field is located between the final lens and the beam forming region, and for focusing the plurality of electron beams in both the horizontal and vertical directions and weakening focusing action on the plurality of electron beams according to the increase in an amount of deflection of the plurality of electron beams. The at least one correction lens has an electrode configuration in which trajectories of outer electron beams among the plurality of election beams are deflected one of toward and away from a trajectory of a center electron beam among the plurality of electron beams according to the increase in an amount of deflection of the plurality of electron beams.

15 Claims, 7 Drawing Sheets

U.S. PATENT DOCUMENTS

| | | |
|---|---|---|
| 4,225,128 | 9/1980 | Holyoke . |
| 4,701,678 | 10/1987 | Blacker et al. . |
| 4,704,565 | 11/1987 | Blacker, Jr. et al. . |
| 5,015,910 | 5/1991 | Takahashi et al. . |
| 5,027,043 | 6/1991 | Chen et al. . |
| 5,212,423 | 5/1993 | Noguchi et al. . |
| 5,608,284 | 3/1997 | Tojyou et al. . |
| 5,739,631 | 4/1998 | Tojyou et al. . |
| 6,025,674 * | 2/2000 | Tojyou et al. ..... 313/414 |

FOREIGN PATENT DOCUMENTS

| | | |
|---|---|---|
| 0511488 | 11/1992 | (EP) . |
| 0 901 146 A2 | 3/1999 | (EP) . |
| 5-266822 | 10/1993 | (JP) . |
| 5-325825 | 12/1993 | (JP) . |
| WO 91/02373 | 2/1991 | (WO) . |

* cited by examiner

COLOR CATHODE RAY TUBE HAVING A LOW DYNAMIC FOCUS VOLTAGE

CROSS REFERENCE TO RELATED APPLICATION

This is a continuation of U.S. application Ser. No. 09/012,450, filed Jan. 23, 1998 now U.S. Pat. No. 6,025,674, which is a continuation of U.S. application Ser. No. 08/808,037, filed Mar. 4, 1997, now U.S. Pat. No. 5,739,631, which is a continuation of U.S. application Ser. No. 08/504,139, filed Jul. 19, 1995, now U.S. Pat. No. 5,608,284, issued Mar. 4, 1997, the subject matter of which is incorporated by reference herein.

BACKGROUND OF THE INVENTION

The present invention relates to a color cathode ray tube and more particularly to a color cathode ray tube having an electron gun providing a satisfactory resolution over the entire picture with a comparatively low dynamic focus voltage.

In a color cathode ray tube used as a color picture tube or a display tube, it is necessary to control the focus characteristic of the electron gun properly according to the angle of deflection of electron beams so as to provide a satisfactory resolution always over the entire screen.

FIG. 3 is a cross sectional schematic view illustrating the structure of this kind of conventional color cathode ray tube. Numeral 1 indicates an evacuated glass envelope, 2 a faceplate portion constituting a screen, 3 a phosphor screen, 4 a shadow mask, 5 an internal conductive coating, 6, 7, and 8 cathodes, 9 a first grid electrode (G1 electrode), 10 a second grid electrode (G2 electrode), 11 a third grid electrode (G3 electrode), 12 a fourth grid electrode (G4 electrode), 13 a fifth grid electrode (G5 electrode), 14 an accelerating electrode (G6 electrode), 15 a shield cup, 16 a deflection yoke, 17, 18, and 19 initial paths of electron beams, and 20 and 21 center lines of passage aperture of outer electron beams (hereinafter referred to as apertures) formed in the accelerating electrode 14.

In the figure, a phosphor screen 3 comprising an alternate line pattern of red, green, and blue emitting phosphors is supported on the inner wall of the faceplate portion 2 of the evacuated glass envelope 1. The center lines (the initial paths of electron beams) 17, 18, and 19 of the cathodes 6, 7, and 8 coincide with the center lines of apertures associated with corresponding cathodes, of the G1 electrode 9, the G2 electrode 10, and the G3 electrode 11, the G4 electrode 12, and the G5 electrode (focus electrode) 13, these three constituting the main lens, and the shield cup 15 and are arranged almost in parallel with each other in a common plane (inline arrangement).

The center line of the aperture at the center of the G6 electrode (accelerating electrode) 14 which is another electrode constituting the main lens coincides with the center line 18. However, the center lines 20 and 21 of both the apertures on the outer side do not coincide with the center lines 17 and 19 corresponding to them but are slightly displaced outwardly.

Three electron beams emitted from the cathodes 6, 7, and 8 enter the final lens (main lens) formed between the G5 electrode 13 and the G6 electrode 14 along the center lines 17, 18, and 19.

A focus voltage V*f* of about 5 to 10 kV is applied on the G3 electrode 11 and the G5 electrode 13 and an accelerating voltage Eb which is the highest voltage of about 20 to 30 kV is applied on the G6 electrode 14 via the conductive coating 5 and the shield cup 15 placed in the evacuated glass envelope 1.

The center lines of the apertures at the centers of both of the G5 electrode 13 and the G6 electrode 14 constituting the final lens for focusing electron beams on the phosphor screen 3 are coaxial, so that a lens formed in the aperture portion at the center is axially symmetric and an electron beam (center beam) passing through the aperture at the center is focused by the final lens and goes straight along the axis.

On the other hand, the center lines of the outer apertures of both the electrodes constituting the final lens are displaced from each other, so that a non-axially-symmetric lens is formed in the outer aperture portion. As a result, an electron beam (outer beam) passing through the outer apertures passes through a portion displaced toward the center beam from the center line of the lens in the diverging lens region formed on the side of the accelerating electrode (G6 electrode) 14 in the lens region, so that it is subjected to the focusing action by the lens and the converging force toward the center beam at the same time.

Also known is a type of an electron gun in which each of two electrodes constituting a final lens has a single horizontally elongated opening at their opposing ends and has a plate electrode therein having beam passage apertures retracted inwardly from the opposing ends.

Also in this type of an electron gun, a non-axially-symmetric lens is formed in the outer aperture portion of both the electrodes and the outer electron beams are given the converging force toward the center beam, and the three electron beams are converged so as to be superposed in the plane of the shadow mask 4.

An operation for converging each electron beam by an electrode structure like this is referred to as a static convergence (STC).

Furthermore, each electron beam is subjected to color selection by the shadow mask 4 and only a portion of each electron beam passes through an aperture of the shadow mask 4 for exciting the phosphor of a color corresponding to the electron beam on the phosphor screen 3 to luminescence and reaches the phosphor screen 3.

A magnetic deflection yoke 16 for scanning electron beams on the phosphor screen 3 is mounted outside the funnel portion of the evacuated glass envelope 1.

As mentioned above, it is known that when an inline electron gun in which three electron beam passage apertures are arranged in a horizontal plane and a so-called selfconverging type deflection yoke for forming a special nonhomogeneous magnetic field distribution are combined, by adjusting a self-convergence of the three beams at the center of the picture, the convergence can be adjusted over the entire remaining picture at the same time. However, when the self-converging type deflection yoke is used, a problem arises that large aberration due to deflection are generated by non-uniformity of the magnetic field and the resolution at the corners of the screen lowers.

FIG. 4 is a schematic view illustrating beam spots on the screen by an electron beam subjected to aberrations due to deflection. Numeral 3 indicates a phosphor screen (hereinafter may be referred to as a screen) and 3*a*, 3*b*, and 3*c* beam spots.

In the figure, the beam spot 3*a* is almost circular at the center of the screen 3. However, at the corners of the screen, as indicated by the beam spots 3*b* and 3*c*, a high brightness portion indicated by hatching (core) c widens in the horizontal direction (X—X direction) and a low brightness portion (halo) h widens in the vertical direction (Y—Y direction) and the resolution lowers. Conventionally, as an example for solving such a problem, an electron gun is disclosed in U.S. Pat. No. 5,212,423 (corresponding Japanese Patent Application Laid-Open Hei 4-43532).

FIG. 5 is an illustration for the constitution of an electron gun of the prior art for reducing the lowering of the resolution at the corners of the screen.

In the figure, the G5 electrode 13 is divided into four parts such as a first member 13*h*, a second member 13*i*, a third member 13*j*, and a fourth member 13*k* toward the phosphor screen from the cathode.

A single opening is provided in the end face of the third member 13*j* opposite to the fourth member 13*k* and a plate electrode 131 having an electron beam passage aperture is located therein.

Plate correction electrodes 13*m* are located at the end face of the fourth member 13*k* opposite to the third member 13*j* so as to sandwich the electron beam passage aperture vertically and extend into the third member 13*j* through the single opening of the third member.

A voltage V*d* varying dynamically in synchronization with the deflection current supplied to the deflection yoke is applied on the second member 13*i* and the fourth member 13*k* and a fixed voltage V*o*is applied on the first member 13*h* and the third member 13*j*.

By using such a constitution, an electrostatic quadrupole lens having a function for changing the cross sectional shape of an electron beam into a non-axially symmetrical one in accordance with the amount of deflection of the electron beam is formed between the third member 13*j* and the fourth member 13*k*. Between the two aforementioned voltages V*o*and V*d*, there is a relationship of V*o*>V*d*.

The final lens (main lens) formed between the fourth member 13*k* and the G6 electrode 14 produces an effect for focusing an electron beam horizontally stronger than vertically.

In such a structure of an electron gun, when an amount of deflection is small, the voltage difference between the third member 13*j* and the fourth member 13*k* is large, so that a cross section of the electron beam is elongated horizontally by the electrostatic quadrupole lens but it is offset by the astigmatism of the final lens elongating the cross section of the electron beam strongly vertically and degradation of the resolution at the center of the screen is prevented.

On the other hand, when an amount of deflection is large, the voltage V*d* varying dynamically in synchronization with the deflection current increases and the potential difference between the third member 13*j* and the fourth member 13*k* decreases. Therefore, the strength of the electrostatic quadrupole lens weakens and the cross sectional shape of the electron beam is vertically elongated by a function of the final lens for focusing strongly horizontally.

Namely, the astigmatism caused in the electron beam produces an effect that the core c is elongated vertically and the halo h is elongated horizontally. Therefore, the astigmatism caused by the deflection of an electron beam shown in FIG. 4 can be eliminated and the resolution at the corners of the screen can be improved.

In the color cathode ray tube, the distance from the final lens to the corners of the screen is longer than the distance to the center of the screen, so that the electron beam focusing condition, that is, the focus voltage is different between the center and the corners of the screen. When this focus voltage is fixed at the voltage at which an electron beam is focused at the center of the phosphor screen, a problem arises that an electron beam is not focused at the corners of the phosphor screen and hence the resolution lowers.

However, in the constitution example of a conventional electron gun explained in FIG. 5, when the electron beam is deflected toward the corners of the screen, the potential of the fourth member 13*k* is increased, so that the potential difference from the accelerating voltage Eb of the accelerating electrode 14 reduces and the strength of the final lens weakens. As a result, the electron beam focusing point moves toward the phosphor screen and the electron beam can be focused also at the corners of the phosphor screen. Namely, since the electron gun has a function for correcting the curvature of the image field, degradation of the resolution at the corners can be prevented also from this point of view.

At the same time, the strengths of both the lens formed between the first member 13*h* and the second member 13*i* constituting a part of the G5 electrode 13 and the lens formed between the second member 13*i* and the third member 13*j* constituting another part of the G5 electrode 13 weaken as the dynamically varied voltage (dynamic focus voltage) Vd increases. Namely, since the two aforementioned lenses also have a function for correcting the curvature of the image field, an efficient correction of curvature of the image field can be made. These two lenses are called a correction lens for curvature of the image field.

Namely, dynamic correction of astigmatism and correction of curvature of the image field can be realized by a comparatively low dynamic focus voltage at the same time.

SUMMARY OF THE INVENTION

Recently there is a tendency to increase the angle of deflection and the dynamic focus voltage for realization of a large-screen, flat, and thin cathode ray tube and an electron gun for a cathode ray tube having improved efficiency in a dynamic correction of astigmatism and a correction of the curvature of the image field is required.

To correct the curvature of the image field more efficiently, there may also be considered an electrode constitution in which a lens having a function for correcting the curvature of the image field is formed between the second member 13*i* and the third member 13*j* and between the third member 13*j* and the fourth member 13*k* mentioned above respectively and an electrostatic quadrupole lens having a function for correcting astigmatism is formed between the first member 13*h* and the second member 13*i*.

However, in an electron gun for a cathode ray tube constituted in this way, the electrostatic quadrupole lens having a function for correcting astigmatism is placed farther away from the final lens for focusing an electron beam on the phosphor screen and the sensitivity of correction of astigmatism lowers.

Therefore, it is necessary to increase the sensitivity of correction of astigmatism further in addition to an increase in the sensitivity of correction of curvature of the image field. When the length of the plate correction electrode 13*m* in the axial direction is lengthened so as to improve correction sensitivity, a problem arises that the plate correction electrode is deformed at the time of assembly because of the disproportionate length of the plate correction electrode and the beam spots on the screen are distorted.

It can be considered to use an electrostatic quadrupole lens of a structure that eliminates a possibility of deformation of correction electrodes and enhances sensitivity of correction of astigmatism. However, the function for contributing to convergence of the electron beams possessed by a conventional electrostatic quadrupole lens is lost by the electrostatic quadrupole lens in which the sensitivity of correction of astigmatism is increased and a problem of insufficient beam convergence arises.

The problem of beam convergence is that as an amount of deflection of an electron beam increases, the lens strength of the final lens weakens and the non-axially-symmetric components of lens action produced by the outer apertures also weaken at the same time and the force for converging the outer electron beams toward the center beam weakens. This will be explained with reference to FIG. 6.

FIG. 6 illustrates the convergence correction action of the electrostatic quadrupole lens of the aforementioned electron gun of the prior art.

When a voltage V*d* applied to the correction plate electrode 13*m* located in the end face of the fourth member 13*k* is higher than a voltage V*o* applied to the third member 13*j* in FIG. 5, the resultant electric field as illustrated by dashed lines in FIG. 6 exerts a force on the two outer electron beams to converge them toward the center electron beam to supplement convergence of the three beams. On the contrary, when the voltage V*d* is lower than the voltage V*o*, the resultant electric field exerts a force on the two outer beams to move them away from the center electron beam.

On the other hand, in the structure of the electrostatic quadrupole in which the sensitivity of correction of astigmatism is increased by placement of vertically oriented plates on opposite sides of each aperture in addition to two horizontally oriented parallel plates on opposite sides of the three electron beams, electric fields for converging the outer beams toward the center beam are eliminated by the vertically oriented plate correction electrode and cannot contribute to convergence.

The electrostatic quadrupole lens is located in the neighborhood of the triode portion farther away from the final lens. Therefore, even if it is desired to converge the outer beams with the electrodes of the electrostatic quadrupole lens, a problem arises that the displacement of the trajectory of the outer beam from the center line of the outer lens is in the final lens is large, the focus characteristic is adversely affected, and the convergence effect on the outer beams is reduced.

The present invention has been made in the aforementioned situation and an object of the present invention is to provide a color cathode ray tube having an electron gun for achieving a good resolution over the whole screen area at a comparatively low dynamic focus voltage without a problem of convergence.

To accomplish the above object, the present invention is characterized in that in a color cathode ray tube having an electron gun comprising at a least a first electrode means for generating a plurality of electron beams from the cathode and directing these electron beams toward the phosphor screen along initial paths in parallel with each other in a plane and a second electrode means constituting a main lens for focusing the electron beams on the phosphor screen, a final lens for focusing electron beams on the phosphor screen among the lenses constituting the main lens has a function for vertically elongating the cross section of the electron beams and a function for weakening the lens strength according to an increase in an amount of deflection of the electron beams, at least one multipole lens acting so as to elongate a cross section of the electron beams less horizontally with an increasing amount of deflection of the electron beams is located between the final lens and the first electrode means, at least one correction lens for curvature of the image field for weakening its focusing action on the electron beams in the horizontal and vertical directions according to an increase in an amount of deflection of the electron beams is placed between the final lens and the multipole lens, and at least one of the multipole lens and the correction lens for curvature of the image field has an electrode constitution in which the trajectories of the outer electron beams among the aforementioned plurality of electron beams are deflected inwardly according to an increase in an amount of deflection of the electron beams.

In a color cathode ray tube having an electron gun of the aforementioned constitution, a lens having the function for correcting curvature of the image field is formed in the neighborhood of the final lens in addition to the final lens having the function for correcting curvature of the image field, so that a correction of curvature of the image field is achieved with a comparatively low dynamic focus voltage and a satisfactory resolution is produced over the whole screen area.

A lens having a function for varying the trajectories of the electron beams passing through the outer apertures according to an increase in an amount of deflection of the electron beams supplements the convergence function of the final lens for focusing the electron beams on the phosphor screen and a satisfactory resolution is obtained over the whole screen area without a problem of convergence.

The dynamic focus voltage is about 1000 V, for example, for a 32-inch color cathode ray tube of a conventional electron gun. However, in the present invention, it is about 600 to 700 V. In a 37-inch color cathode ray tube, the dynamic focus voltage in the present invention is about 900 V, while that was 1500 V for a conventional electron gun, that is, the desired dynamic focus can be obtained with a comparatively low voltage and the breakdown voltage capacity of a lead embedded in a glass stem of the cathode ray tube for supplying a focus voltage can be improved easily.

DETAILED DESCRIPTION OF THE PREFERRED EMBODIMENTS

The embodiments of the present invention will be explained in detail hereunder with reference to the accompanying drawings.

Figure 1:
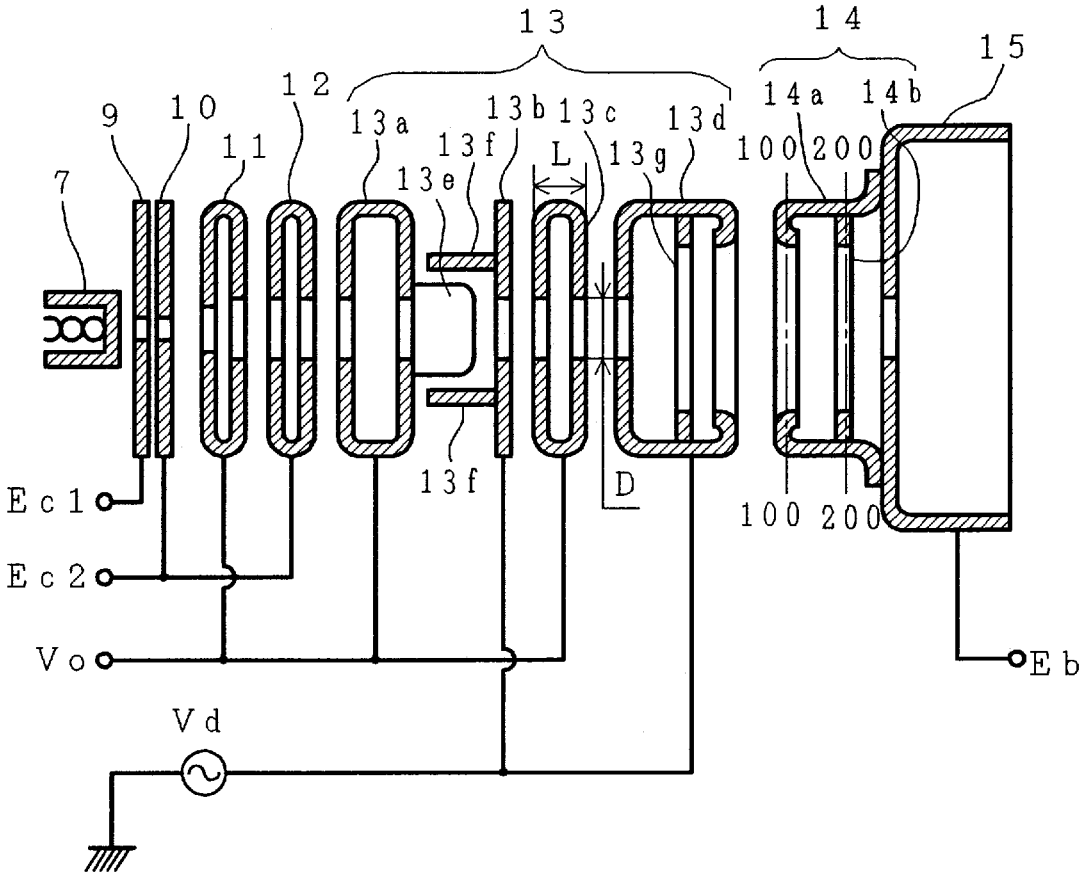
FIG. 1(*a*) is an axial cross sectional schematic view of an electron gun for illustrating an embodiment of a color cathode ray tube, and FIG. 1(*b*) is a cross sectional view along section line 100—100 of the electron gun shown in FIG. 1(*a*), and FIG. 1(*c*) is a cross sectional view along section line 200—200 of the electron gun shown in FIG. 1(*a*).
Figure 1:
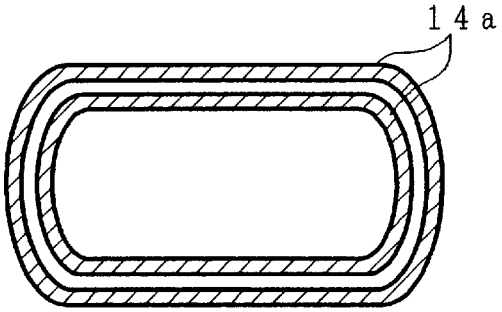
Figure 1:
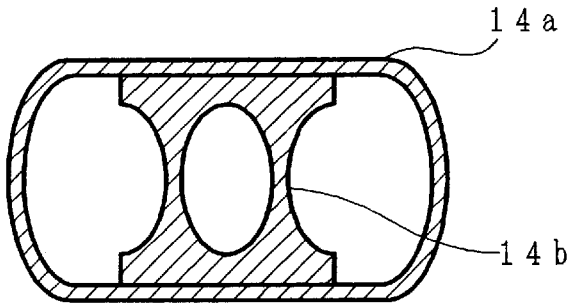

FIGS. 1(*a*) to 1(*c*) are schematic views of an electron gun for illustrating an embodiment of a color cathode ray tube of the present invention, and FIG. 1(*a*) is an axial cross sectional schematic view viewed in a direction of an arrangement of inline guns, and FIG. 1(*b*) is a cross sectional view along the section line 100—100 shown in FIG. 1(*a*), and FIG. 1(*c*) is a cross sectional view along the section line 200—200 shown in FIG. 1(*a*).

Figure 2:
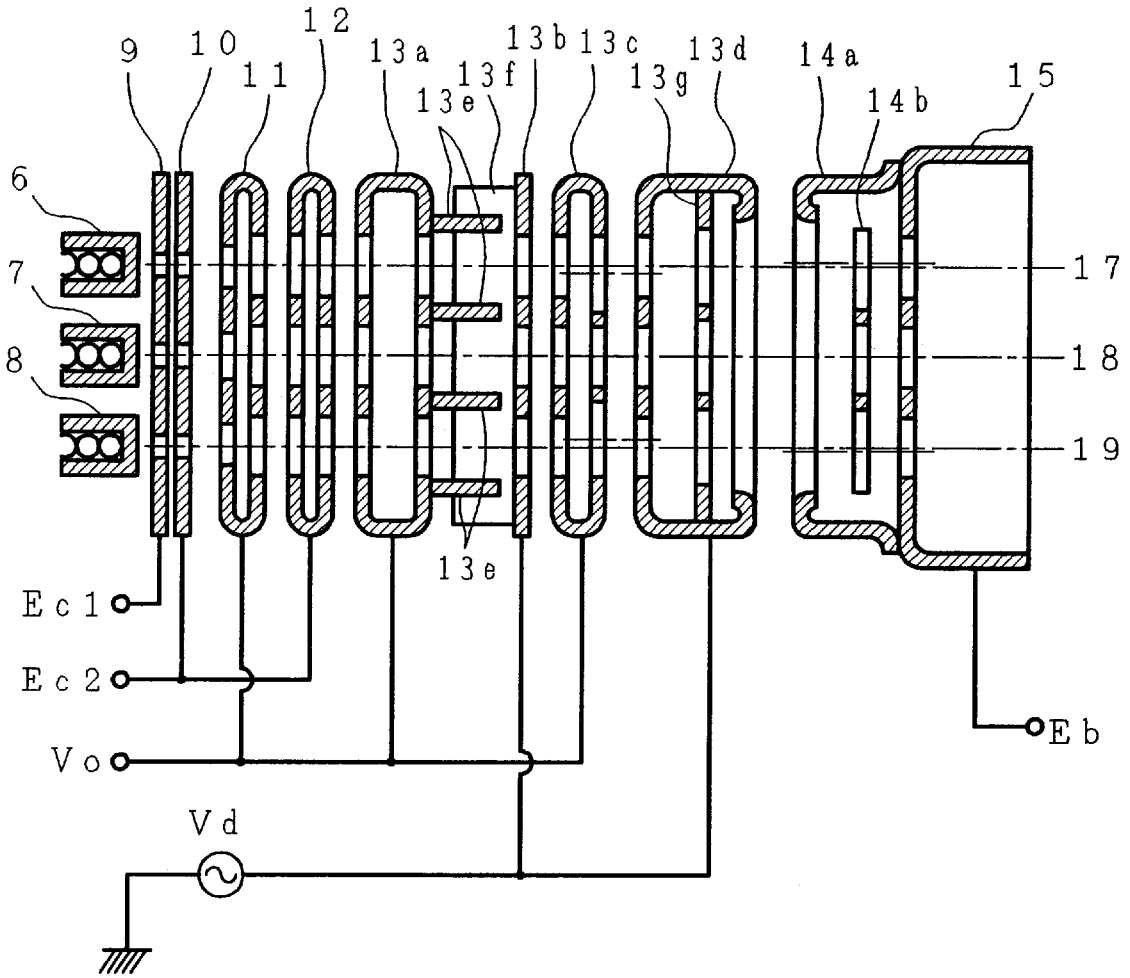
FIG. 2 is an axial cross sectional schematic view of the electron gun shown in FIG. 1 viewed in the direction perpendicular to a direction of an arrangement of inline guns.
Figure 3:
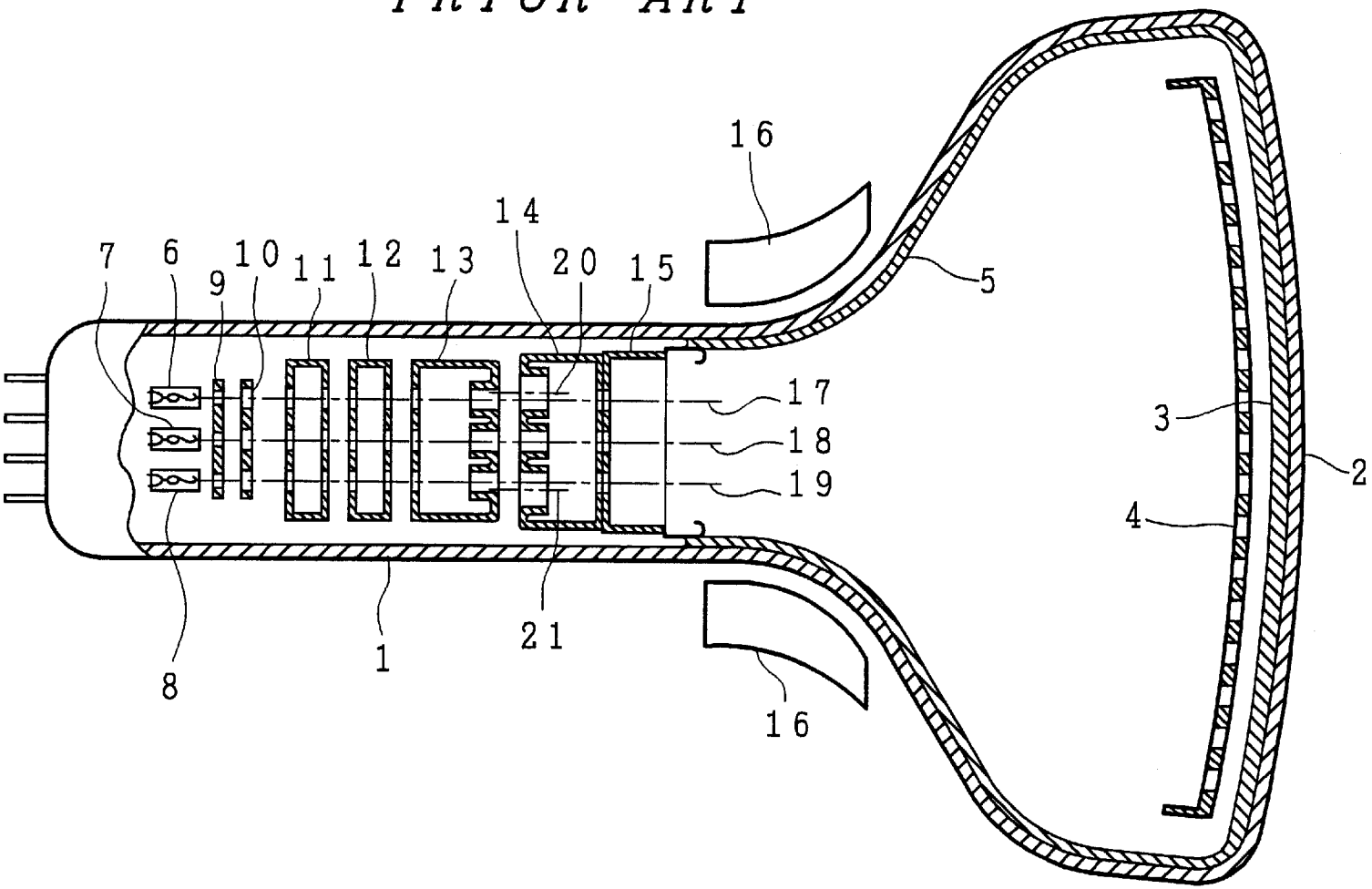
FIG. 3 PRIOR ART
FIG. 3 is a cross sectional schematic view illustrating the structure of a conventional color cathode ray tube.

FIG. 2 is an axial cross sectional schematic view of the electron gun shown in FIG. 1(*a*) viewed in the direction perpendicular to a direction of an arrangement of inline guns.

Figure 5:
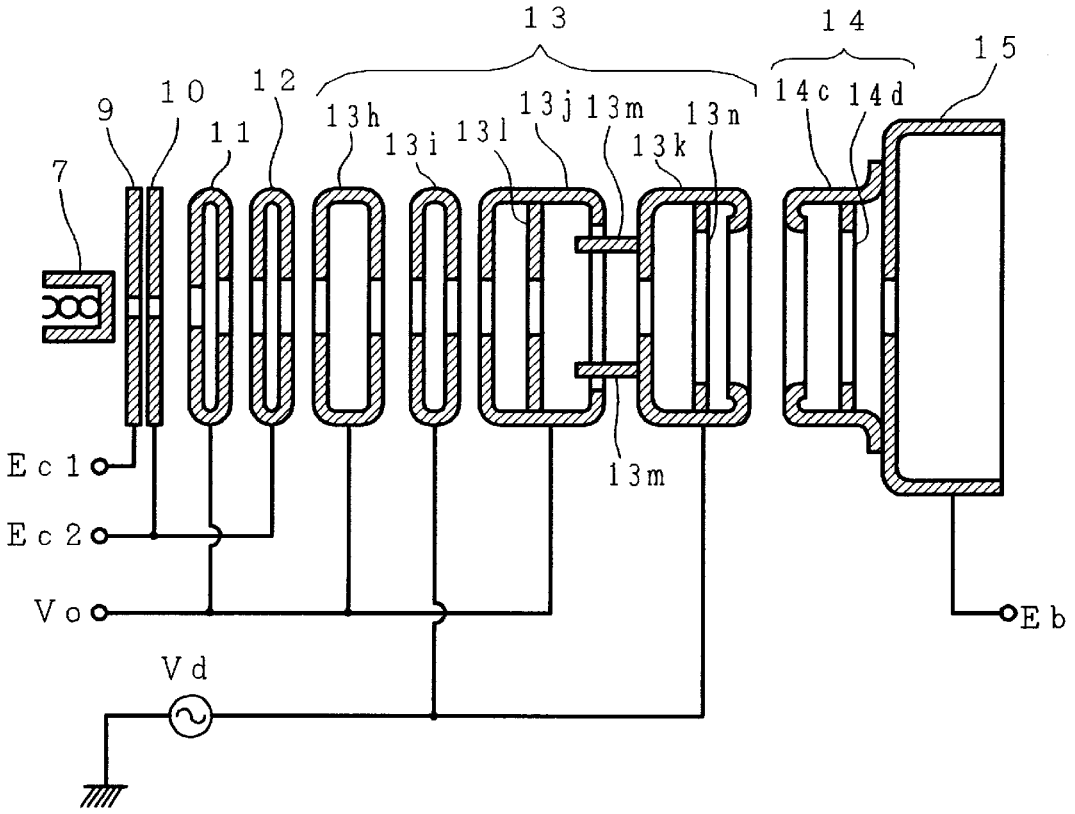
FIG. 5 PRIOR ART
FIG. 5 is an illustration for the constitution of an electron gun of the prior art for reducing the deterioration of the resolution at the corners of the screen.
Figure 6:
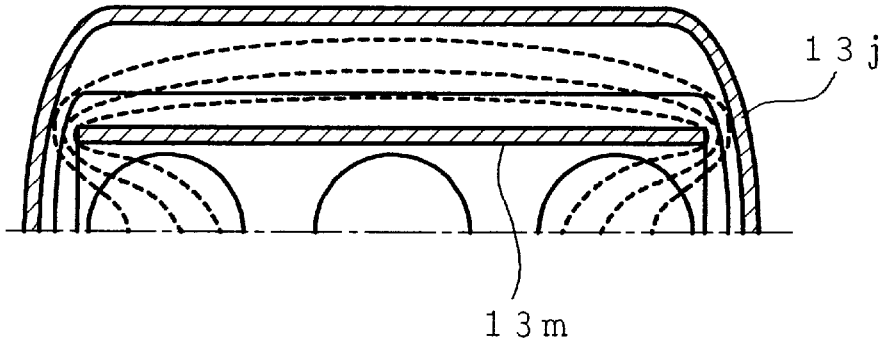
FIG. 6 is an illustration for the convergence correction action by an electrostatic quadrupole lens of an electron gun of the prior art.

In the figures, each same numeral as that shown in FIG. 5 corresponds to the same portion and the focus electrode 13 located adjacent to the accelerating electrode 14 is divided into 4 parts such as a first member 13*a*, a second member 13*b*, a third member 13*c*, and a fourth member 13*d* toward the phosphor screen from the cathode 7 (6, 8).

Plate correction electrodes 13*e* (13*e*, 13*e*, 13*e*) vertically oriented, extending toward the second member 13*b* and electrically connected with the first member 13*a* are arranged so as to horizontally sandwich the electron beam passage apertures formed in the surface of the first member 13*a* opposite to the second member 13*b*.

Plate correction electrodes 13*f* (13*f*) horizontally oriented, extending toward the first member 13*a* and electrically connected with the second member 13*b* are arranged so as to vertically sandwich the electron beam passage aperture formed in the surface of the second member 13*b* opposite to the first member 13*a*.

The aforementioned plate correction electrodes 13*e* and 13*f* vertically and horizontally oriented are arranged so that they partially interdigitate with each other, but not in contact with each other.

The center lines of the electron beam passage apertures formed in the surface of the third member 13*c* opposite to the fourth member 13*d* is displaced inwardly with respect to the center lines of the electron beam passage aperture formed in the surface of the fourth member 13*d* opposite to the third member 13*c*.

In a lens (main lens) formed between the fourth member 13*d* having an inner electrode 13*g* and the accelerating electrode (a cylinder-like electrode 14*a* of the G6 electrode 14) having an inner electrode 14*b*, an electron lens formed by three vertically long apertures formed in the inner electrode 13*g* of the fourth member 13*d*, a horizontally long single opening horizontally oriented, and three vertically long apertures formed in the inner electrode 14*b* of the G6 electrode 14 as shown in FIGS. 1(*a*), 1(*b*), and 1(*c*) has a function for elongating the cross section of electron beams strongly vertically.

Figure 7:
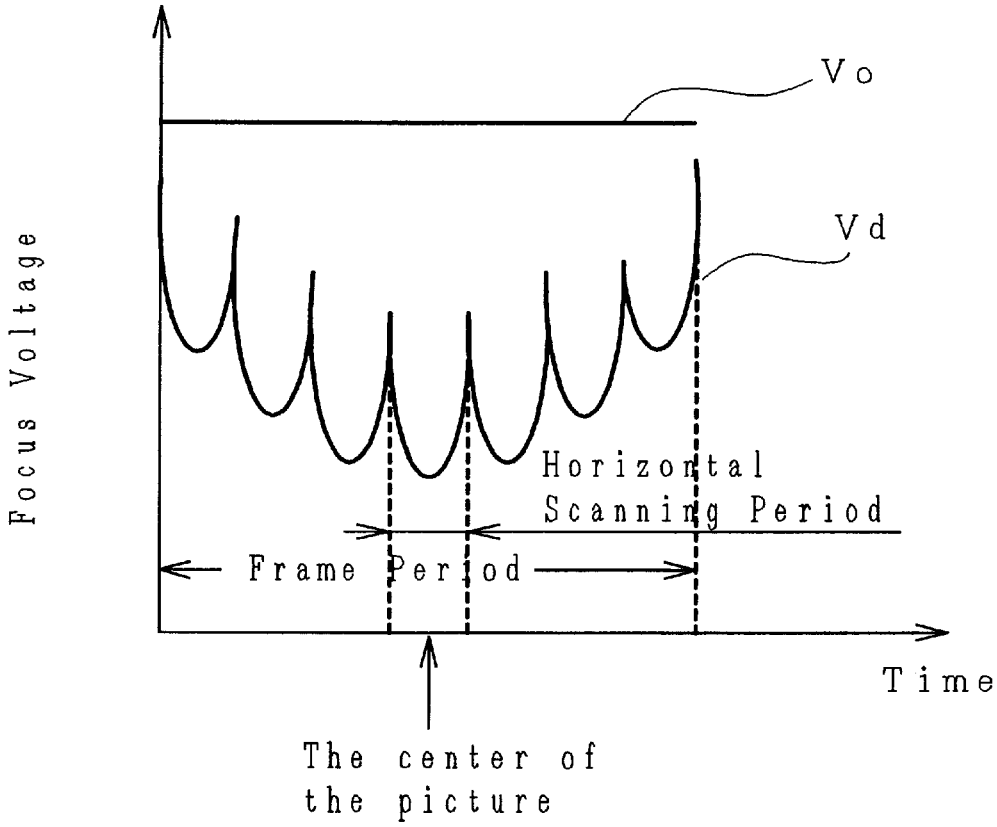
FIG. 7 shows a waveform of an embodiment of a focus voltage and a dynamic focus voltage applied on a color cathode ray tube of the present invention.

A fixed voltage V*o* is applied on the first member 13*a* and the third member 13*c* and a voltage V*d* varying dynamically in synchronization with deflection of electron beams is applied on the second member 13*b* and the fourth member 13*d*. An example of waveforms of the two aforementioned voltages V*o* and V*d* is shown in FIG. 7. In this case, there is a relationship of V*o*>V*d*.

When an amount of deflection of the electron beams is small in such a structure of an electron gun, the voltage difference between the first member 13*a* and the second member 13*b* is large, so that the cross section of the electron beams is elongated horizontally by the electrostatic quadrupole lens. However, it is offset by the astigmatism of the main lens which elongates the cross section of the electron beams strongly vertically and degradation of the resolution at the center of the screen is prevented.

On the other hand, when an amount of deflection of electron beams is large, the dynamically varied voltage V*d* increases and the potential difference between the first member 13*a* and the second member 13*b* decreases, so that the strength of the electrostatic quadrupole lens weakens and the cross sectional shape of the electron beams is made vertically long by the function of the final lens of elongating the cross section of the electron beams vertically.

Figure 4:
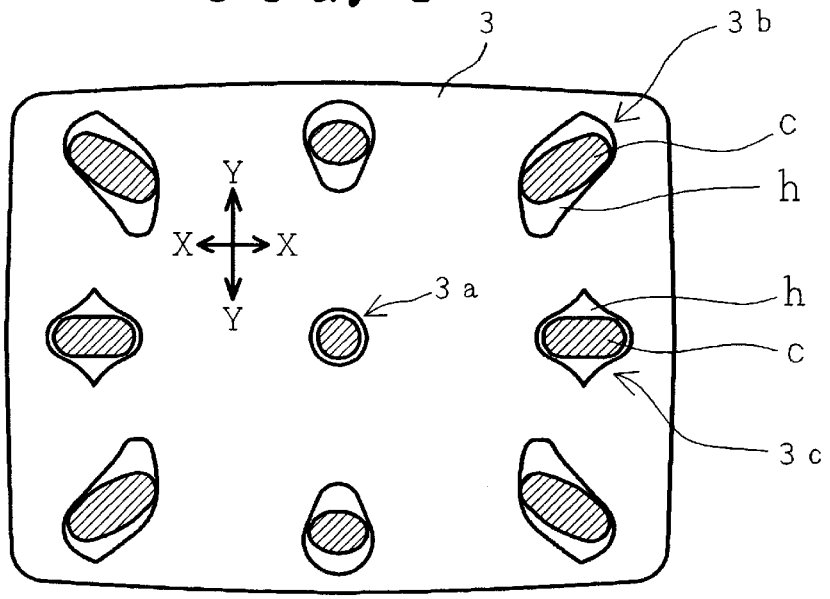
FIG. 4 is a schematic view illustrating beam spots on the screen by electron beams subjected to aberrations due to deflection.

Namely, the astigmatism caused in the electron beams produces an effect for elongating the cores c of the beam spots shown in FIG. 4 vertically and the halos h horizontally, so that the astigmatism caused by the deflection of the electron beams shown in FIG. 4 can be eliminated and the resolution at the corners of the screen can be improved.

When the electron beams are deflected toward the corners of the screen, the potential of the fourth members 13*d* and 13*g* of the focus electrode 13 increases, so that the potential difference between the potential of the fourth member and the accelerating voltage E*b* of the electrodes 14*a* and 14*b* constituting the accelerating electrode 14 decreases and the strength of the final lens weakens. As a result, the focus points of the electron beams move toward the phosphor screen and the electron beams can be focused also at the corners of the phosphor screen. Namely, the electron gun has the function for correcting curvature of the image field, so that degradation of the resolution at the corners can be prevented also.

At the same time, the lens formed between the second member 13*b* and the third member 13*c* of the focus electrode 13 and the lens formed between the third member 13*c* and the fourth member 13*d* of the focus electrode 13 also weaken in strength as the dynamically varied voltage V*d* increases. Namely, the two aforementioned lenses also have the function for correcting curvature of the image field respectively and are arranged adjacent to the final lens, so that an efficient correction of curvature of the image field can be made.

When the length L of the third member 13*c* is shorter than the diameter of the aperture D thereof, the two correction lens for curvature of the image field formed before and after the third member 13*c* cannot operate as two independent electron lenses.

Therefore, a problem arises that not only the correction sensitivity for curvature of the image field lowers but also the shape of electron beam spots on the screen is distorted. The correction sensitivity of the correction lens for curvature of the image field formed on the cathode side of the third member 13*c* electrode lowers as the length of the third member 13*c* increases and when it is longer than 2.5 times the diameter of the aperture D, the correction sensitivity will be almost the same as that of a conventional electron gun. It is desirable to set the length of the third member 13*c* to be 1 to 2.5 times the diameter of the electron beam passage aperture formed in the third member.

The center line of the center aperture of the lens aperture formed by the electrodes 14*a* and 14*b* constituting the accelerating electrode 14 coincides with the center line 18 of the cathode 7. However, the center lines of both the outer apertures which lie on a line through each side edge of the inner electrode 14*b* shown in FIG. 1(*c*) are displaced slightly outwardly with respect to the center lines 17 and 19 of the cathodes 6 and 8 corresponding to the two outer apertures and the outer electron beams are converged inwardly.

The lens formed between the third member 13*c* and the fourth member 13*d* of the focus electrode 13 converges the trajectories of the outer electron beams inwardly as an amount of deflection of the electron beams increases, so that a decrease in convergence of the two outer beams due to deflection of the electron beams by the final lens can be made up for and degradation of the convergence characteristic can be prevented.

Figure 8:
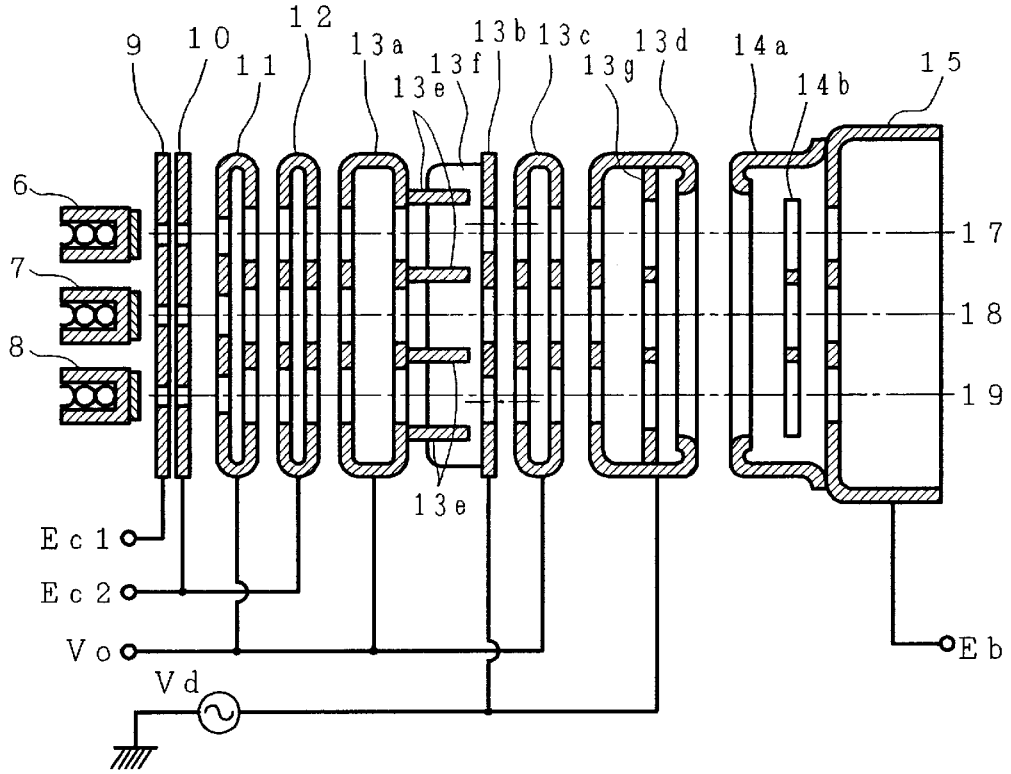
FIG. 8 is a cross sectional view showing an embodiment of an electrode constitution in which the trajectories of the outer electron beams are deflected inwardly according to an increase in an amount of deflection of the electron beams relating to a color cathode ray tube of the present invention.
Figure 9:
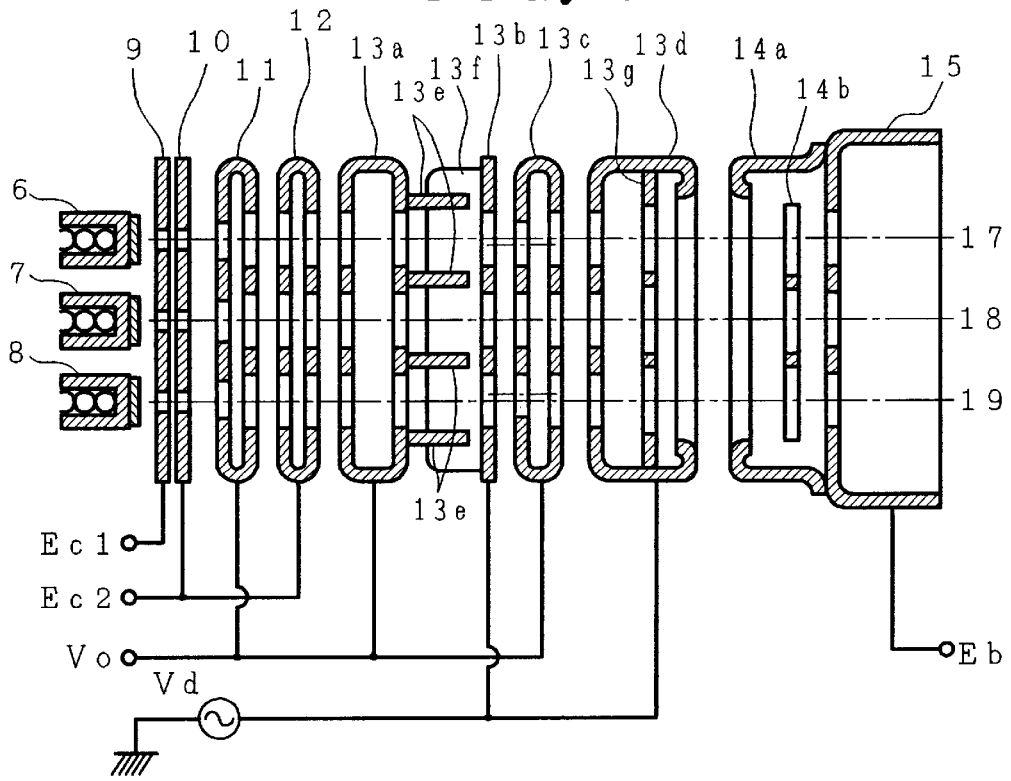
FIG. 9 is a cross sectional view showing another embodiment of an electrode constitution in which the trajectories of the outer electron beams are deflected inwardly according to an increase in an amount of deflection of the electron beams relating to a color cathode ray tube of the present invention.
Figure 10:
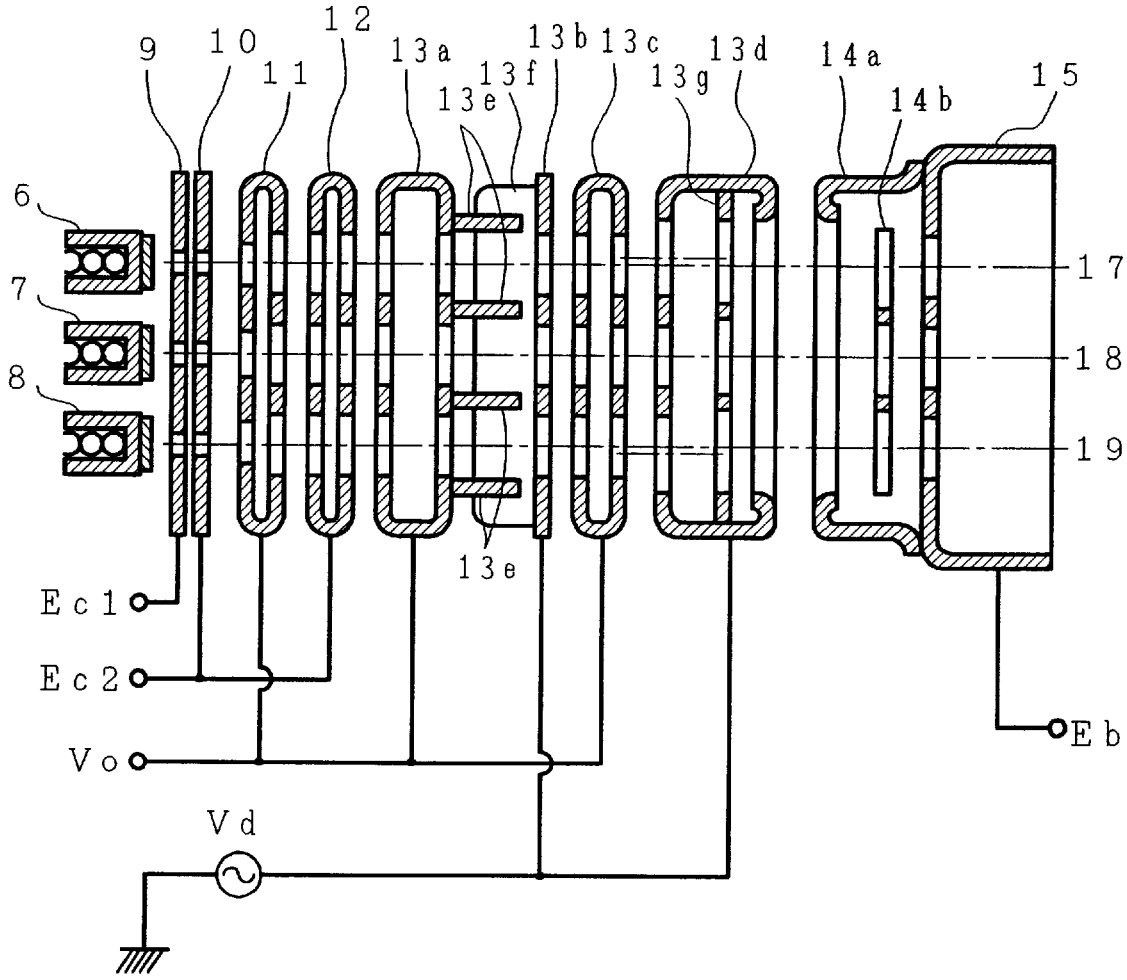
FIG. 10 is a cross sectional view showing still another embodiment of an electrode constitution in which the trajectories of the outer electron beams are deflected inwardly according to an increase in an amount of deflection of the electron beams relating to a color cathode ray tube of the present invention.

The electrode constitution for deflecting the trajectories of the outer electron beams inwardly according to an increase in an amount of deflection of the electron beams is not limited to the aforementioned embodiment. The center lines of the outer apertures of the second member 13*b* may be displaced outwardly with respect to the center lines 17 and 19 of the cathodes 6 and 8 for the outer electron beams as shown in FIG. 8, or the center lines of the outer apertures of the third member 13*c* on the second member 13*b* side may be displaced inwardly with respect to the center lines 17 and 19 of the cathodes 6 and 8 for the outer electron beams as shown in FIG. 9, or the center lines of the outer apertures of the fourth member 13*d* on the third member 13*c* side may be displaced outwardly with respect to the center lines 17 and 19 of the cathodes 6 and 8 for the outer electron beams as shown in FIG. 10.

As the above explanation shows, by using a color cathode ray tube having an electron gun of the present invention, the focus characteristic over the whole screen area can be improved with a comparatively low dynamic focus voltage and the problem of degradation in convergence is avoided at the same time, so that an image of a satisfactory resolution can be reproduced over the whole screen area.

What is claimed is:

1. A color cathode ray tube having an electron gun comprising:

a beam forming region for generating a plurality of electron beams from cathodes and directing said plurality of electron beams toward a phosphor screen along initial paths in a horizontal plane;

a main lens for focusing said plurality of electron beams on said phosphor screen;

said main lens including a final lens configured so that said plurality of electron beams are focused in both a horizontal direction and a vertical direction, outer electron beams among said plurality of electron beams are deflected toward a trajectory of a center electron beam among said plurality of electron beams, and a lens strength thereof weakens with an increase in an amount of deflection of said plurality of electron beams;

at least one correction lens for curvature of an image field located between said final lens and said beam forming region, and for focusing said plurality of electron beams in both the horizontal and vertical directions and weakening focusing action on said plurality of electron beams according to the increase in an amount of deflection of said plurality of electron beams;

said at least one correction lens for curvature of the image field having an electrode configuration in which trajectories of outer electron beams among said plurality of election beams are deflected one of toward and away from a trajectory of a center electron beam among said plurality of electron beams according to the increase in an amount of deflection of said plurality of electron beams.

2. A color cathode ray tube according to claim 1, wherein a force exerted by said final lens to deflect the outer beams toward the center electron beam weakens with increasing deflection of said plurality of electron beams.

3. A color cathode ray tube according to claim 1, wherein said final lens is configured such that electron beam passage apertures associated with the outer electron beams form a non-axially-symmetric lens.

4. A color cathode ray tube according to claim 3, wherein center lines of outer electron beam passage apertures formed in two opposing electrodes forming said final lens are displaced from each other in said horizontal plane.

5. A color cathode ray tube according to claim 1, wherein each of two directly opposing and spaced ends of electrodes forming said final lens is formed with a single horizontally-elongated opening common for said plurality of electron beams.

6. A color cathode ray tube according to claim 5, wherein said final lens is comprised of two cylinder-like electrodes each formed with said single horizontally-elongated opening at an end thereof and each provided with a plate electrode having electron beam passage apertures therein.

7. A color cathode ray tube according to claim 6, wherein said plate electrode is retracted inwardly from said end of said cylinder-like electrode.

8. A color cathode ray tube according to claim 7, wherein said electron beam passage apertures are vertically elongated.

9. A color cathode ray tube according to claim 8, wherein said final lens focuses said plurality of electron beams stronger in a horizontal direction than in a vertical direction.

10. A color cathode ray tube according to claim 1, wherein said at least one correction lens for curvature of the image field has said electrode configuration in which the trajectories of said outer electron beams are deflected inwardly toward the trajectory of the center electron beam according to the increase in an amount of deflection of said plurality of electron beams.

11. A color cathode ray tube according to claim 10, wherein center lines of outer electron beam passage apertures formed in opposite surfaces of two electrodes forming said at least one correction lens for curvature of the image field are displaced from each other in said horizontal plane.

12. A color cathode ray tube according to claim 11, wherein said center lines of said outer electron beam passage apertures formed in one of said two electrodes supplied with a first voltage are displaced inwardly toward the trajectory of the center electron beam with respect to said center lines of said outer electron beam passage apertures formed in the other of said two electrodes supplied with a second voltage lower than said first voltage, in said horizontal plane.

13. A color cathode ray tube according to claim 1, wherein said at least one correction lens for curvature of the image field having an electrode configuration in which the trajectories of the outer electron beams are deflected toward the trajectory of the center electron beam according to the increase in an amount of deflection of said plurality of electron beams is located adjacent to said final lens.

14. A color cathode ray tube according to claim 1, wherein said at least one correction lens for curvature of the image field is located adjacent to said final lens.

15. A color cathode ray tube according to claim 1, wherein an electrode among a plurality of electrodes constituting said at least one correction lens for curvature of the image field has a fixed potential applied thereto and has a length of 1 to 2.5 times a diameter of electron beam passage apertures formed therein.

* * * * *